US005273106A

United States Patent [19]

Drake

[11] Patent Number: 5,273,106

[45] Date of Patent: Dec. 28, 1993

[54] SELF-DEFROSTING RECUPERATIVE AIR-TO-AIR HEAT EXCHANGER

[75] Inventor: Richard L. Drake, Delmar, N.Y.

[73] Assignee: Mechanical Technology Inc., Latham, N.Y.

[21] Appl. No.: 918,217

[22] Filed: Jul. 21, 1992

[51] Int. Cl.[5] ..... F28F 5/00; F28F 13/00; F28F 17/00; F28F 27/00

[52] U.S. Cl. ..... 165/96; 165/17; 165/54; 165/164

[58] Field of Search ..... 165/17, 54, 164, 165, 165/166, 155, 96, 97

[56] References Cited

U.S. PATENT DOCUMENTS

| | | | |
|---|---|---|---|
| 3,705,618 | 12/1972 | Jouet et al. | 165/166 |
| 4,391,321 | 7/1983 | Thunberg | 165/54 |
| 4,754,806 | 7/1988 | Astle, Jr. | 165/54 |
| 5,035,117 | 7/1991 | Drake | 62/93 |

FOREIGN PATENT DOCUMENTS

| | | | |
|---|---|---|---|
| 0153138 | 9/1982 | Japan | 165/54 |
| 0155841 | 8/1985 | Japan | 165/54 |
| 0594403 | 2/1978 | U.S.S.R. | 165/17 |
| 0817475 | 3/1981 | U.S.S.R. | 165/54 |
| 0898220 | 1/1982 | U.S.S.R. | 165/54 |
| 1153224 | 4/1985 | U.S.S.R. | 165/54 |

OTHER PUBLICATIONS

Shurcliff, William A. "Air-to-Air Head Exchangers for Houses" Chapter 23 Enercon Exchangers copyright 1982 pp. 135-139.

*Primary Examiner*—John K. Ford
*Attorney, Agent, or Firm*—Kane, Dalsimer, Sullivan, Kurucz, Levy, Eisele and Richard

[57] ABSTRACT

A heat exchanger includes a stationary spirally or concentrically wound heat exchanger core with rotating baffles on upper and lower ends thereof. The rotating baffles include rotating inlets and outlets which are in communication with respective fixed inlets and outlets via annuli. The rotation of the baffles causes a concurrent rotation of the temperature distribution within the stationary exchanger core, thereby preventing frost build-up in some applications and preventing the formation of hot spots in other applications.

12 Claims, 3 Drawing Sheets

SELF-DEFROSTING RECUPERATIVE AIR-TO-AIR HEAT EXCHANGER

The Government of the United States of America has rights in this invention pursuant to Contract No. DE-FG07-88ID12788 awarded by the U.S. Department of Energy.

BACKGROUND OF THE INVENTION

1. Field of the Invention

This invention pertains to a heat exchanger which uses rotating baffles with a spiral or concentric plate counter flow core to vary the inlet and outlet of the gasses in which heat is being exchanged in order to defrost efficiently the heat exchanger.

2. Description of the Prior Art

Control of frost formation has long been a source of energy consumption and equipment inefficiency in many electrically driven applications involving heating, cooling and ventilation. In these fields, one must deal with the accumulation of frost or ice on heat exchanger and air duct surfaces. Two common prior art approaches are the use of an automatic defrost cycle, where external energy is applied periodically to melt accumulated frost; and the use of a backup heat exchanger, which can be put into service while the primary heat exchanger is allowed to defrost naturally. These conventional approaches are deficient in that primary energy is often used to melt the frost directly; the equipment involved operates less efficiently as frost builds up prior to a periodic defrost cycle due to restricted air flow paths and reduced heat transfer effectiveness; and the latent heat of fusion of the frost is generally lost. Accordingly, much design effort is typically put into optimizing conventional periodic defrost cycles in terms of time and energy consumption.

OBJECTS AND SUMMARY OF THE INVENTION

It is therefore an object of this invention to provide a heat exchanger which does not have its operation impaired by the build-up of frost which restricts air flow paths and reduces heat transfer effectiveness.

It is therefore a further object of this invention to provide a heat exchanger which does not require the direct application of primary energy to defrost the heat exchanger.

It is therefore a still further object of this invention to provide a heat exchanger which utilizes the latent heat of fusion of any frost which happens to form and subsequently melt within the heat exchanger.

It is therefore a still further object of this invention to provide a heat exchanger which is light weight, low cost, and of simple design.

It is therefore a final object of this invention to provide a heat exchanger which does not require a redundant secondary or backup heat exchanger to be put into service while a primary heat exchange is allowed to defrost.

Typical applications for such a heat exchanger, particularly an air-to-air heat exchanger, include architectural applications where energy efficiency and air freshness are both desired, grocery store applications where very low humidity air is required, various commercial and industrial processes which use refrigeration for drying (a specific example is where solvents such as volatile organic compounds used in a manufacturing process are recovered by condensation such as is disclosed in commonly owned U.S. Pat. No. 5,035,117, wherein the condensation normally occurs below 32° F., therefore any moisture in the air stream freezes on the coil, reducing the effectiveness of the coil and contaminating the solvent), and heating applications for the passenger compartment in electric vehicles.

The apparatus is based on the following premises:

1. In any conventional heat exchanger, a steady-state temperature gradient will be developed along the length of the metal heat exchange surface.
2. Frost will form at a location within the heat exchanger where the metal surface temperature which is in contact with warm, moist air drops below 32° F.
3. The potential exists for continuously melting the accumulating frost, if the frost formation zone is continuously exposed to a hotter inlet air temperature.

Accordingly, the present invention continuously moves the frost formation zone to a warmer section of the exchanger as frost begins to form. This is accomplished by a stationary spiral or concentric (or similar) plate counter flow core with upper and lower rotating baffles providing a moving inlet and outlet for both the warmer and the cooler air. A stationary pressure vessel surrounds both the core and the moving baffles and includes stationary inlets and outlets in communication with the respective moving inlets and outlets.

While this embodiment is particularly drawn to the prevention of the formation of frost, this configuration can be used to prevent the formation of hot spots. Such applications include:

1. Use with hazardous liquids, wherein a hot spot in a conventional heat exchanger could cause the fluid to approach or exceed its flash point or fire point temperature.
2. Use with liquid heat transfer media to prevent hot spots from vaporizing the liquid, leading to vapor lock problems.
3. Use with fluids which have an inherently high vaporization temperature, but have to be extremely dry to prevent the water from vaporizing. The elimination of hot spots could reduce the fluid dryness specifications.
4. Use of lower melting-point heat transfer surface materials (even plastic) which might fail at localized hot spots with a conventional heat exchanger.
5. Use in food preparation applications, where a more constant heat gradient is desirable, and hot spots are undesirable from final food product or meal quality.
6. Use in the food processing industry to attain constant temperature heat transfer in place of a steam system.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
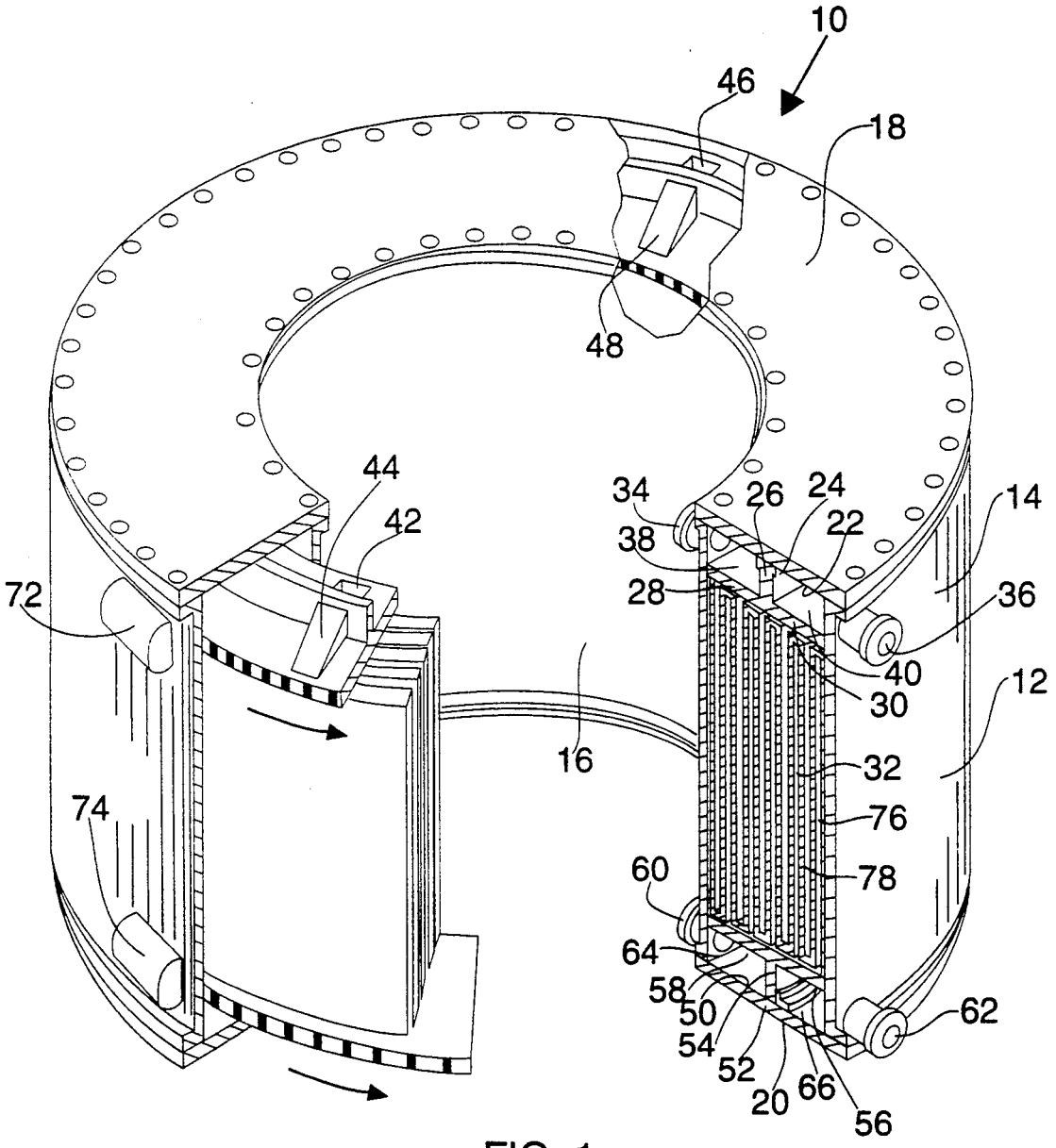
FIG. 1 is a top perspective view, partially in cross section, of the apparatus of the present invention.

Referring now to the drawings in detail wherein like numerals refer to like elements throughout the several views, FIG. 1 is a top perspective view of heat exchanger 10.

Heat exchanger 10 includes a stationary toroidal or doughnut shaped pressure vessel 12 with a cylindrical vertical outer wall 14, a cylindrical vertical inner wall 16, an upper planar wall 18, and a lower planar wall 20.

Interior face 22 of upper planar wall 18 includes upper female track 24 in which stem 26 of upper T-shaped movable baffle 28 rides. Cross-bar 30 of movable baffle 28 abuts stationary spiral plate counter flow core 32 (the spiral plate structure of core 32 may be replaced with similar structures, such as concentric plates). Baffle 28 is typically of foam filled stainless steel sheet metal construction. The surface of baffle 28 having sliding contact with core 32 is typically laminated with a thin 0.1" thick layer of polytetrafluoroethylene (Teflon®). Cylindrical vertical inner wall 16 includes fixed cold air inlet nozzle 34 while cylindrical vertical outer wall 14 includes fixed cold air outlet nozzle 36. Fixed cold air inlet nozzle 34 communicates with upper inner circular annulus 38 which is formed between an inner portion of cross-bar 30, stem 26, upper planar wall 18 and cylindrical vertical inner wall 16. Likewise, fixed cold air outlet nozzle 36 communicates with upper outer circular annulus 40 which is formed between an outer portion of cross-bar 30, stem 26, upper planar wall 18 and cylindrical vertical outer wall 14.

Inner portion of cross-bar 30 includes moving cold air inlet 42 which extends substantially over a radial portion of cross-bar 30 by way of sloped extension 44. Likewise, outer portion of cross-bar 30 includes moving cold air outlet 46 (180° from moving cold air inlet 42) which extends substantially over a radial portion of cross-bar 30 by way of sloped extension 48. There is no communication between upper inner circular annulus 38 and upper outer circular annulus 40 except by way of moving cold air inlet 42, spiral plate counter flow core 32, and moving cold air outlet 46 as will be described in further detail herein.

Interior face 50 of lower planar wall 20 includes lower female track 52 in which stem 54 of lower T-shaped movable baffle 56 (which is substantially identical except for orientation to upper T-shaped movable baffle 28) rides. Cross-bar 58 of movable baffle 56 abuts stationary spiral plate counter flow core 32. Cylindrical vertical inner wall 16 includes fixed hot air inlet nozzle 60 while cylindrical vertical outer wall 14 includes fixed hot air outlet nozzle 62. Fixed hot air inlet nozzle 60 communicates with lower inner circular annulus 64 which is formed between an inner portion of cross-bar 58, stem 54, lower planar wall 20 and cylindrical vertical inner wall 16. Likewise, fixed hot air outlet nozzle 62 communicates with lower outer circular annulus 66 which is formed between an outer portion of cross-bar 58, stem 54, lower planar wall 20 and cylindrical vertical outer wall 14.

Inner portion of cross-bar 58 includes moving hot air inlet 68 (see FIG. 3) which extends substantially over a radial portion of cross-bar 58 by way of a sloped extension (not shown, similar to 44 as shown in FIG. 1). Likewise, outer portion of cross-bar 58 includes moving hot air outlet 70 which extends substantially over a radial portion of cross-bar 58 by way of a sloped extension (not shown, similar to 48 as shown in FIG. 1). There is no communication between lower inner circular annulus 64 and lower outer circular annulus 66 except by way of moving hot air inlet 68, spiral plate counter flow core 32, and moving hot air outlet 70 as will be described in further detail herein.

Cylindrical vertical outer wall 14 includes baffle moving mechanisms 72, 74 to rotate baffles 28, 56, respectively, preferably in unison. Mechanisms 72, 74 may include an electrically or pneumatically driven plunger which progressively indexes baffles 28, 56 in a rachet and pawl fashion. Alternately, mechanisms 72, 74 may include a direct motor driving belt or gearing or any other suitable mechanism known to those skilled in the art.

Figure 2:
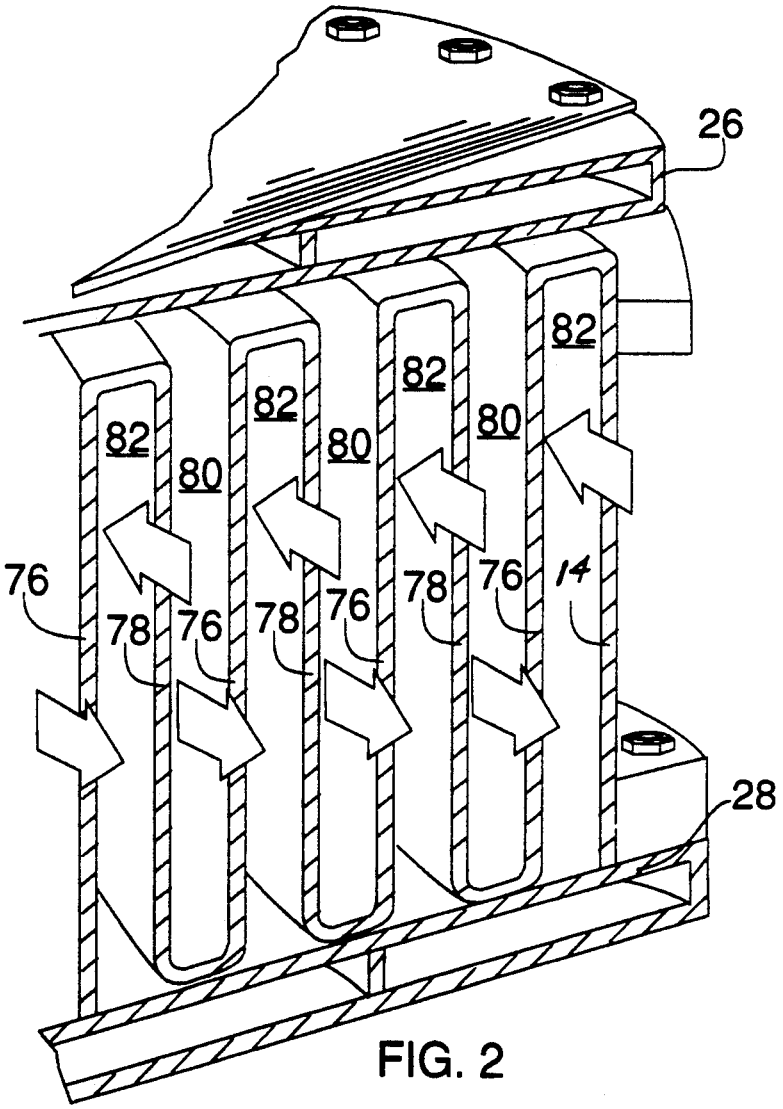
FIG. 2 is a cross-sectional view of the spiral plate counter flow core of the present invention.

As shown in FIG. 2, stationary spiral plate counter flow core 32 is formed from metal sheets 76, 78 with alternating edges sealed thereby forming alternating upwardly extending channels 80 and downwardly extending channels 82. Upwardly extending channels 80 are therefore in communication with moving cold air inlet 42 and moving cold air outlet 46 while downwardly extending channels 82 are in communication with moving hot air inlet 68 and moving hot air outlet 70.

Figure 3:
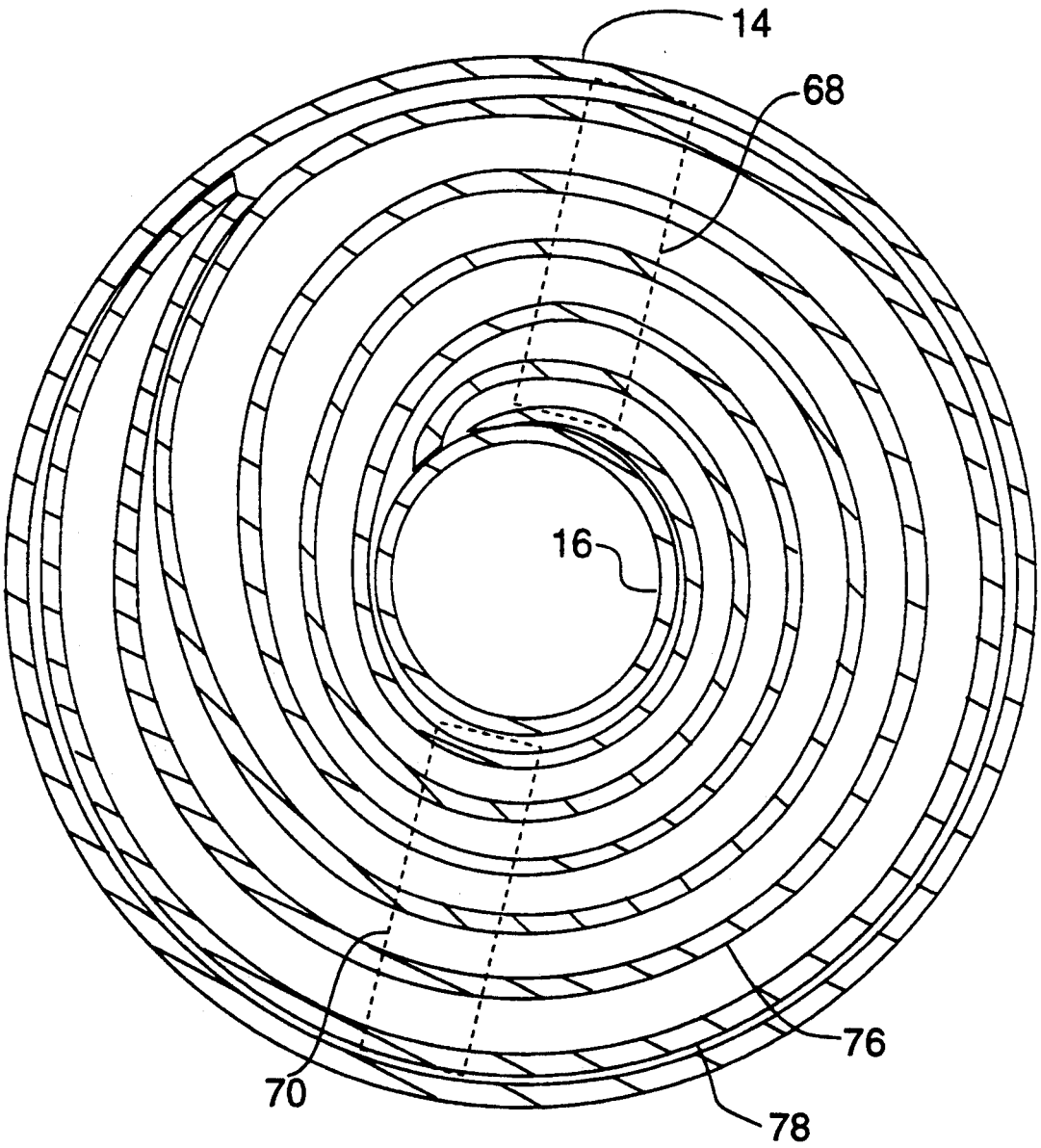
FIG. 3 is a bottom cross-sectional view of the spiral plate counter flow core, with the inlet and outlet of the bottom moving baffle shown in phantom, of the present invention.

Additionally, as shown in FIG. 3, metal sheets 76, 78 of stationary spiral plate counter flow core 32 are wound spirally between cylindrical vertical outer wall 14 and cylindrical vertical inner wall 16.

In this configuration, cold (typically dry) air is inlet through fixed cold air inlet nozzle 34 into upper inner circular annulus 38. The cold air then flows through moving cold air inlet 42 into upwardly extending channels 80 of stationary spiral plate counter flow core 32 and out moving cold air outlet 46 to upper outer circular annulus 40 and fixed cold air outlet nozzle 36. Simultaneously, hot (typically wet) air is inlet through fixed hot air inlet nozzle 60 into lower inner circular annulus 64. The hot air then flows through moving hot air inlet 68 into downwardly extending channels 82 of stationary spiral plate counter flow core 32 and out moving hot air outlet 70 to lower outer circular annulus 66 and fixed hot air outlet nozzle 62. As upwardly extending channels 80 and downwardly extending channels 82 are separated by thin metal sheets 76, 78, substantial heat exchange occurs between the hot air and the cold air. Frost will form at a location within the heat exchanger where the metal surface temperature which is in contact with hot, moist air drops below 32° F. However, by rotating baffles 28, 56, (and consequently inlets 42, 68 and outlets 46, 70), the frost formation zone is continuously exposed to a hotter inlet air temperature by moving the frost formation zone to a warmer section of the exchanger 10 as frost begins to form. In other words, the moving baffles 28, 56 move the highest and lowest temperature points around the perimeter of the heat exchanger 10. As the inlet moves, this frost line moves also causing the previously formed frost to melt (the resulting liquid being drained off by gravity), thereby recovering the latent heat of fusion from the frost and avoiding the need to use a secondary source of heat to melt the frost. Further, heat exchanger 10 can thereby be defrosted while in use without any substantial degradation in performance due to excessive build-up of frost.

The rate of baffle movement can be set to a predetermined rotational velocity (typically 0.5 to 10 revolutions per hour) or controlled as a function of the frost build-up by the monitoring of gas pressure drop or in any other suitable manner.

Alternately, as previously described, this configuration can be used to avoid hot spots in a liquid heat exchanger.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A heat exchanger including:

a core including a first fluid path adjacent to a second fluid path, said first fluid path and said second fluid path being separated by a heat exchange surface;

a first inlet and a first outlet to said first fluid path;

a second inlet and a second outlet to said second fluid path;

means for continually moving said first inlet and said first outlet with respect to said core;

wherein said first inlet, first fluid path, and said first outlet are maintained in fluid communication with each other and wherein said second inlet, said second fluid path and said second outlet are maintained in fluid communication with each other.

2. The heat exchanger of claim 1 further including means for continually moving said second inlet and said second outlet with respect to said core.

3. The heat exchanger of claim 2 wherein said means for moving includes a first rotating baffle adjacent to said core and wherein said first inlet and said first outlet are included on said first rotating baffle.

4. The heat exchanger of claim 3 wherein said means for moving includes a second rotating baffle adjacent to said core and wherein said second inlet and said second outlet are included on said second rotating baffle.

5. The heat exchanger of claim 4 wherein said core has an outer cylindrical surface within a pressure vessel; said first baffle is circularly shaped and upwardly adjacent from said core; and said second baffle is circularly shaped and downwardly adjacent from said core.

6. The heat exchanger of claim 5 wherein said core is stationary with respect to said pressure vessel and said first baffle and said second baffle rotate with respect to said core.

7. The heat exchanger of claim 6 wherein said first and second baffles rotate substantially in unison.

8. The heat exchanger of claim 7 wherein said core includes a first sheet and a second sheet spirally wound around a central portion.

9. The heat exchanger of claim 8 wherein said first sheet and said second sheet are alternately sealed at respective upper and lower edges thereof thereby alternately forming said first fluid path and said second fluid path therebetween.

10. The heat exchanger of claim 5 wherein said pressure vessel includes a first fixed inlet, a first fixed outlet, a second fixed inlet and a second fixed outlet.

11. The heat exchanger of claim 10 wherein said first baffle includes an inverted T-structure with a first cross-bar abutting said core and an upwardly extending stem abutting an upper surface of said pressure vessel, thereby forming an upper inner annulus and an upper outer annulus, wherein said upper inner annulus is in communication with one of said first fixed inlet and said first fixed outlet and said upper outer annulus is in communication with another of said first fixed inlet and said first fixed inlet, wherein said upper inner annulus is further in communication with one of said first moving inlet and said first moving outlet and said upper annulus is in communication with another of said first moving inlet and said first moving outlet.

12. The heat exchanger of claim 11 wherein said second baffle includes a T-structure with a second cross-bar abutting said core and a downwardly extending stem abutting a lower surface of said pressure vessel, thereby forming a lower inner annulus and a lower outer annulus, wherein said lower inner annulus is in communication with one of said second fixed inlet and said second fixed outlet and said lower outer annulus is in communication with another of said second fixed inlet and said second fixed inlet, wherein said lower inner annulus is further in communication with one of said second moving inlet and said second moving outlet and said lower outer annulus is in communication with another of said second moving inlet and said second moving outlet.

* * * * *